United States Patent [19]

Matsuura et al.

[11] 4,114,365

[45] Sep. 19, 1978

[54] BATTERY LEAD PLATE MEMBER FOR AN ELECTRONIC WRIST WATCH

[75] Inventors: Eiichi Matsuura; Keikichi Takahashi; Nobuo Tsukada; Yoshio Tatsumi, all of Tokyo, Japan

[73] Assignee: Kabushiki Kaisha Daini Seikosha, Japan

[21] Appl. No.: 747,188

[22] Filed: Dec. 3, 1976

[30] Foreign Application Priority Data

Dec. 5, 1975 [JP] Japan ..... 50-165096[U]

[51] Int. Cl.[2] ..... G04C 3/00

[52] U.S. Cl. ..... 58/23 BA; 29/628; 29/629; 339/263 B

[58] Field of Search ..... 58/23 R, 23 BA; 29/628, 29/629; 339/17 R, 17 C, 263 B

[56] References Cited

U.S. PATENT DOCUMENTS

| | | | |
|---|---|---|---|
| 3,945,193 | 3/1976 | Yasuda et al. | 58/23 BA |
| 3,966,498 | 6/1976 | Wuthrich | 58/23 BA X |
| 3,977,176 | 8/1976 | Murakami et al. | 58/23 BA |
| 3,986,334 | 10/1976 | Harper | 58/23 BA X |
| 3,986,335 | 10/1976 | Harper | 58/23 BA X |
| 4,023,347 | 5/1977 | Haber | 58/23 BA X |

FOREIGN PATENT DOCUMENTS

| | | | |
|---|---|---|---|
| 1,133,619 | 3/1957 | France | 58/23.BA |
| 2,260,588 | 6/1973 | Fed. Rep. of Germany | 58/23.BA |
| 471,415 | 5/1969 | Switzerland | 58/23.BA |

*Primary Examiner*—Stanley J. Witkowski

*Attorney, Agent, or Firm*—Robert E. Burns; Emmanuel J. Lobato; Bruce L. Adams

[57] ABSTRACT

A battery lead plate assembly comprises a one-piece integral structure for connecting together a circuit block and a battery of an electronic timepiece. The assembly comprises a casing composed of electrically insulative material and having a slotted arm portion, a lead plate element composed of electrically conductive material and having an end portion inserted into the slot, and an insulating plate composed of electrically insulative material and having an end portion inserted into the slot - all three parts being thermo compression bonded into a one-piece integral structure. The lead plate element is configured so as to contact and make electrical connection between the circuit block and the battery and the insulating plate is configured so as to extend along the side of the lead plate element opposite the battery for electrically insulating the lead plate element from other parts of the timepiece.

3 Claims, 4 Drawing Figures

BATTERY LEAD PLATE MEMBER FOR AN ELECTRONIC WRIST WATCH

BACKGROUND OF THE INVENTION

The present invention relates to a battery lead plate assembly for an electronic wrist watch. The conventional battery lead plate assembly generally has one of the following constructions.

(i) A battery lead plate assembly comprised of a battery lead plate element and a battery lead plate insulating casing formed as one part, and a battery insulating plate as a separate part.

(ii) A battery lead plate assembly comprised of a battery lead plate element and a battery insulating plate formed as one part, and a battery lead plate insulating casing as a separate part.

In the case of (i), the battery lead plate assembly is assembled after the orientation of the battery insulating plate during the assembling process. If the parts are carelessly assembled, the battery insulating plate shears causing the danger of short circuit or deterioration of battery life because of mis-assembly of the battery insulating plate.

In the case of (ii), the assembling process is troublesome since the battery lead plate insulating casing is oriented before assembling and then the battery lead plate assembly is oriented and assembled.

This invention aims to eliminate the above-mentioned difficulties and insufficiencies, and has for its principal object to compose the battery insulating plate, the battery lead plate element and the battery lead plate as a one piece insulating casing integral structure in order to simplify the initial assembling procedure and later servicing.

The present invention will be more fully described with reference to FIGS. 1-4 which show the battery lead plate assembly which comprises a battery lead plate element, 1 made of metal, a battery insulating plate, 2 formed of electrically insulative material and a battery lead plate insulating casing 3 made of electrically insulative plastic material all three parts being integrally connected into a one-piece structure by thermo compression bonding. More particularly, the casing 3 has a slotted arm portion 3*a* in which are inserted end portions of the lead plate element 1 and the insulating plate 2 and then, by application of heat and pressure, the plastic material of the casing 3 fuses together the three parts into a one-piece bonded structure.

Figure 1:
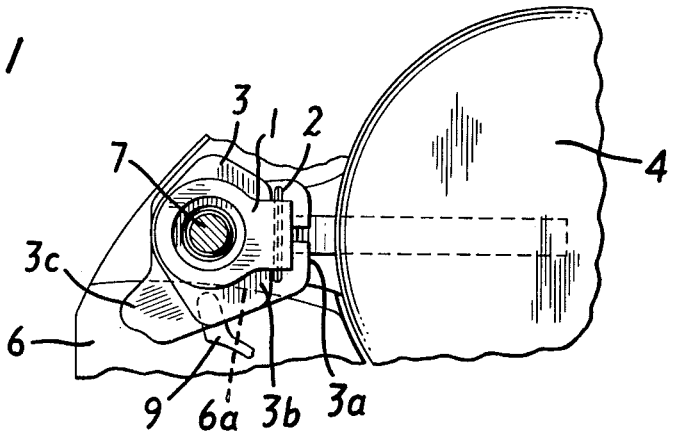
FIG. 1 is a plan view of one embodiment of the present invention in which a battery lead plate assembly and a battery are assembled in a watch body.
Figure 2:
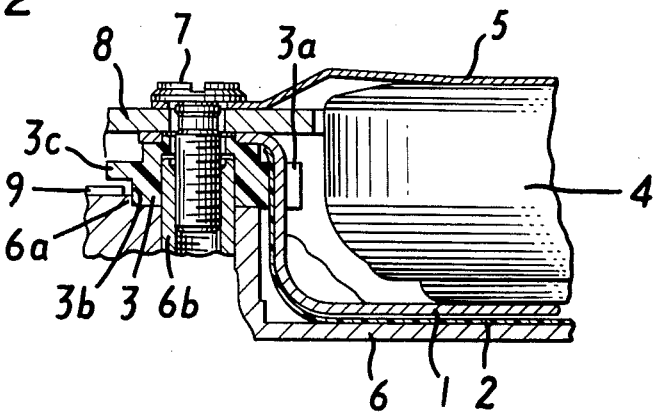
FIG. 2 is a sectional view in which a circuit block a battery, and holder are additionally assembled to FIG. 1.
Figure 3:
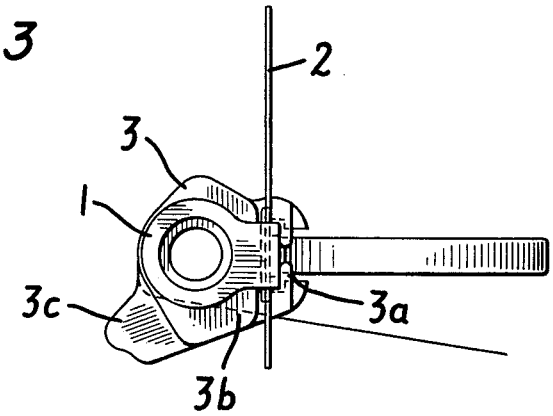
FIG. 3 is a plan view of an embodiment of the battery lead plate assembly according to the present invention and, FIG. 4 is a sectional view of FIG. 3.
Figure 4:
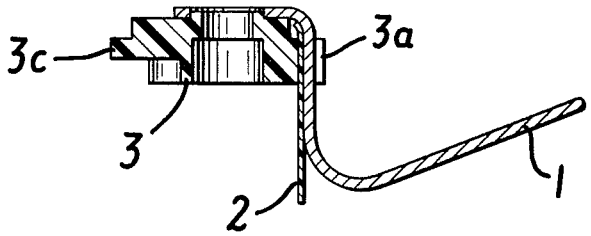

As shown in FIGS. 1 and 2, the battery lead plate 1 serves as a nagative lead of a battery 4. And a battery holder 5 serves as the positive lead with the battery holder 5 being fixed together with a circuit block 8 on the battery lead plate assembly through a tubular sleeve 6*b* and a screw 7. The sleeve 6*b* extends through an opening in a support plate 6 and fits into a cylindrical cavity within the lead plate insulating casing 3, and the support plate 6 is provided with a recessed portion 6*a* in which fits the under portion 3*b* of the battery lead plate insulating casing to thereby position the battery lead plate assembly during assembling. Numeral 9 is a working lever which slides on the upper surface of the plate 6 and movement of the working lever 9 in the upper direction is prevented by a protruding portion 3*c* of the battery lead plate insulating casing 3.

As illustrated, according to the present invention, the afore-mentioned disadvanteges on assembling ae eliminated since the battery lead plate element 1; the battery insulating plate 2 and the battery lead plate insulating casing 3 are performed as a one-piece integral structure. Further, the incorporating position of the battery lead plate assembly is precisely determined by fitting the under portion 3*b* of the battery lead plate insulating casing 3 into the recessed portion 6*a* and by fitting the casing 3 atop the tubular sleeve 6*b* on the plate 6. Furthermore, unwanted movement of the working lever 9 is prevented by the protruding portion 3*c* of the battery lead plate insulating casing 3.

We claim:

1. A battery lead plate assembly comprised of a one-piece integral structure for use in an electronic timepiece for connecting together a circuit block and a battery: said assembly comprising a casing composed of electrically insulative material and having means for connecting said casing to the circuit block and having a slotted arm portion; a lead plate element composed of electrically conductive material and having an end portion thereof inserted into the slot defined by said slotted arm portion and being configured so as to contact and make electrical connection between the circuit block and battery; and an insulating plate composed of electrically insulative material and having an end portion thereof inserted into said slot defined by said slotted arm portion and being configured so as to extend along the side of said lead plate element opposite the battery to thereby electrically insulate said lead plate element from other parts of the timepiece; said casing, lead plate element and insulating plate being integrally bonded into a one-piece structure to facilitate incorporation into and assembly of the timepiece.

2. A battery lead plate assembly according to claim 1; wherein said casing, lead plate element and insulating plate are thermo compression bonded together into a one-piece structure.

3. A battery lead plate assembly according to claim 2; wherein said casing, lead plate element and insulating plate are thermo compression bonded together in the region of said slotted arm portion.

* * * * *